US007785381B2

(12) United States Patent
Oh et al.

(10) Patent No.: US 7,785,381 B2
(45) Date of Patent: Aug. 31, 2010

(54) DUST COLLECTING APPARATUS WITH COMBINED COMPACTING AND FILTER CLEANING FOR A VACUUM CLEANER

(75) Inventors: Jang-Keun Oh, Gwangju (KR); Jung-Gyun Han, Gwangju (KR); Hyoun-Soo Kim, Busan (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 332 days.

(21) Appl. No.: 11/904,423

(22) Filed: Sep. 27, 2007

(65) Prior Publication Data

US 2008/0264007 A1 Oct. 30, 2008

Related U.S. Application Data

(60) Provisional application No. 60/926,832, filed on Apr. 30, 2007.

(30) Foreign Application Priority Data

Jun. 18, 2007 (KR) ..... 10-2007-0059481

(51) Int. Cl.
*B01D 46/00* (2006.01)
*A47L 9/10* (2006.01)

(52) U.S. Cl. ..... 55/300; 55/304; 55/337; 55/429; 55/430; 55/DIG. 3; 15/347; 15/353

(58) Field of Classification Search ..... 55/DIG. 3, 55/295, 296, 300, 304, 337, 430, 432, 433, 55/428–429, 466, 467; 15/347, 353
See application file for complete search history.

(56) References Cited

U.S. PATENT DOCUMENTS 1,038,167 A * 9/1912 Maitland ..... 55/296

(Continued)

FOREIGN PATENT DOCUMENTS

JP 54085560 7/1979

(Continued)

OTHER PUBLICATIONS

Office Action dated Nov. 19, 2009 corresponding to Canadian Patent Application No. 2,618,070.

*Primary Examiner*—Robert A Hopkins
*Assistant Examiner*—Sonji Turner
(74) *Attorney, Agent, or Firm*—Ohlandt, Greeley, Ruggiero & Perle, LLP

(57) ABSTRACT

A dust collecting apparatus for a vacuum cleaner is provided. The dust collecting apparatus includes a dust collecting unit detachably mounted in a main body of the vacuum cleaner, to separate and collect dust from drawn-in air flowing therein; a filter unit disposed above the dust collecting unit, the filter unit comprising a filter to filter fine dust particles contained in air from which the dust has been separated by the dust collecting unit; a top cover to cover the filter unit and to discharge the air filtered through the filter; a rotating unit, which is disposed inside the filter unit, to strike a portion of the filter and to remove the fine dust particles attached to the filter; and a dust compression plate to compress the collected dust while being moved up and down inside the dust collecting unit by power transferred from the rotating unit.

9 Claims, 7 Drawing Sheets

U.S. PATENT DOCUMENTS

| | | | | |
|---|---|---|---|---|
| 1,345,478 | A * | 7/1920 | Cliffe | 55/429 |
| 2,283,836 | A * | 5/1942 | White | 55/429 |
| 2,594,456 | A * | 4/1952 | Kroenlein | 55/296 |
| 3,591,888 | A * | 7/1971 | Takeda et al. | 15/323 |
| 3,621,640 | A * | 11/1971 | Ohno | 55/300 |
| 3,708,962 | A * | 1/1973 | Deguchi et al. | 55/300 |
| 3,841,067 | A * | 10/1974 | Kato et al. | 55/300 |
| 3,856,488 | A * | 12/1974 | Kato et al. | 55/300 |
| 4,533,371 | A * | 8/1985 | Nakamura | 55/299 |
| 4,557,738 | A * | 12/1985 | Menasian | 55/288 |
| 4,592,764 | A * | 6/1986 | Ikezaki et al. | 96/382 |
| 6,192,550 | B1 * | 2/2001 | Hamada et al. | 15/352 |
| 6,524,358 | B2 * | 2/2003 | Yang | 55/337 |
| 6,596,044 | B1 * | 7/2003 | Bilek et al. | 55/337 |
| 6,598,263 | B2 * | 7/2003 | Boles et al. | 15/352 |
| 6,811,584 | B2 * | 11/2004 | Oh | 55/296 |
| 6,824,580 | B2 * | 11/2004 | Oh | 55/295 |
| 6,928,692 | B2 * | 8/2005 | Oh et al. | 15/352 |
| 7,047,593 | B2 * | 5/2006 | Kitamura et al. | 15/353 |
| 7,070,636 | B2 * | 7/2006 | McCormick et al. | 55/299 |
| 7,074,248 | B2 * | 7/2006 | Jin et al. | 55/299 |
| 7,152,276 | B2 * | 12/2006 | Jin et al. | 15/352 |
| 7,171,725 | B2 * | 2/2007 | Sjoberg et al. | 15/348 |
| 7,331,084 | B2 * | 2/2008 | Oh | 15/353 |
| 7,346,957 | B2 * | 3/2008 | Nakamoto et al. | 15/352 |
| 7,351,269 | B2 * | 4/2008 | Yau | 55/297 |
| 7,481,868 | B2 * | 1/2009 | Lee et al. | 95/273 |
| 7,608,123 | B2 * | 10/2009 | Pineschi | 55/429 |
| 7,611,558 | B2 * | 11/2009 | Oh et al. | 55/432 |
| 2003/0159235 | A1 * | 8/2003 | Oh | 15/352 |
| 2003/0159236 | A1 * | 8/2003 | Oh | 15/352 |
| 2004/0163207 | A1 * | 8/2004 | Oh | 15/353 |
| 2006/0123750 | A1 * | 6/2006 | Lee et al. | 55/428 |
| 2007/0017190 | A1 * | 1/2007 | Takemoto et al. | 55/337 |
| 2008/0047094 | A1 * | 2/2008 | Ha et al. | 15/347 |

FOREIGN PATENT DOCUMENTS

| | | |
|---|---|---|
| JP | 2007-020769 | 2/2007 |
| KR | 1020060098765 | 9/2006 |

* cited by examiner

DUST COLLECTING APPARATUS WITH COMBINED COMPACTING AND FILTER CLEANING FOR A VACUUM CLEANER

CROSS-REFERENCE TO RELATED APPLICATIONS

This application claims the benefit under 35 U.S.C. §119 (e) of U.S. Provisional Application No. 60/926,832, filed Apr. 30, 2007, in the United States Patent and Trademark Office and claims the benefit under 35 U.S.C. §119(a) of Korean Patent Application No. 10-2007-0059481, filed Jun. 18, 2007, in the Korean Intellectual Property Office, the disclosure of which is incorporated herein by reference in its entirety.

BACKGROUND OF THE INVENTION

1. Field of the Invention

The present disclosure relates to a vacuum cleaner, and more particularly, to a dust collecting apparatus for a vacuum cleaner, which collects dust from a surface to be cleaned along With drawn-in air drawn-in through a suction nozzle using a suction force generated from a suction motor, filters air drawn in together with dust, and discharges the filtered air to the outside of the vacuum cleaner.

2. Description of the Related Art

In general, dust collecting apparatuses for vacuum cleaners are divided into dust collecting apparatuses using dust bags and bagless dust collecting apparatuses in which dust bins are used semi-permanently. Modern vacuum cleaners mainly include bagless dust collecting apparatuses in which dust bins are used semi-permanently. Such bagless dust collecting apparatuses separate dust from a surface to be cleaned from drawn-in air using vacuum pressure generated between a suction nozzle and the surface to be cleaned, collect the separated dust, filter air from which the dust has been separated, and discharge the filtered air to the outside of the vacuum cleaner.

If a predetermined amount of dust is collected in such a dust collecting apparatus, a user may separate the dust collecting apparatus from a vacuum cleaner and empty the dust collecting apparatus. In this situation, if the dust collecting apparatus has a small size, a user may experience inconvenience due to the frequency with which the dust collecting apparatus needs to be emptied.

In order to solve user inconvenience, Korean Patent Registration No. 634805 and Japanese Open Patent Application No. 2007-20769 disclose dust collecting apparatuses which compress dust collected in dust collecting chambers.

Such dust collecting apparatuses include dust compression plates elastically supported by the dust collecting apparatuses, and ascending/descending members capable of applying power to the dust compression plates. When a user presses the ascending/descending member to move the dust compression plate up or down, dust collected in the dust collecting chamber may be compressed, and thus space available for dust collection may be increased.

Users usually clean the filters of dust collecting apparatuses when emptying dust bins. If a user uses a vacuum cleaner employing a conventional dust collecting apparatus, the user may frequently empty a dust bin, and accordingly may also frequently clean the filter, except for the situation in which a user separates a dust collecting apparatus from a main body of a vacuum cleaner and then cleans a filter, regardless of removing dust from a dust bin.

Accordingly, the period between cleaning operations of the filter of the conventional dust collecting apparatus is long for the reasons described above, and thus the efficiency of the filter in filtering fine dust particles contained in air from which the dust has been separated may be reduced. Additionally, pressure inside the dust collecting apparatus increases due to the difficulty of smoothly discharging air, causing a decrease in the suction force to draw in dirt from a surface to be cleaned.

SUMMARY OF THE INVENTION

An aspect of the present disclosure is to address at least the above problems and/or disadvantages and to provide at least the advantages described below. Accordingly, an aspect of the present disclosure is to provide a dust collecting apparatus for a vacuum cleaner, in which collected dust is compressed in order to increase an amount of dust collected using power that is transferred to simultaneously remove fine dust particles attached to a filter.

According to an aspect of the present disclosure, there is provided a dust collecting apparatus for a vacuum cleaner, including a dust collecting unit, which is detachably mounted in a main body of the vacuum cleaner, to separate and collect dust from drawn-in air flowing therein; a filter unit, which is disposed above the dust collecting unit, the filter unit comprising a filter to filter fine dust particles contained in air from which the dust has been separated by the dust collecting unit; a top cover to cover the filter unit and to discharge the air filtered through the filter; a rotating unit, which is disposed inside the filter unit, to strike a portion of the filter and to remove the fine dust particles attached to the filter; and a dust compression plate to compress the collected dust while being moved up and down inside the dust collecting unit by power transferred from the rotating unit.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Hereinafter, a dust-collecting apparatus of a vacuum cleaner according to exemplary embodiments of the present disclosure will be described in detail with reference to the accompanying drawings.

Figure 1:
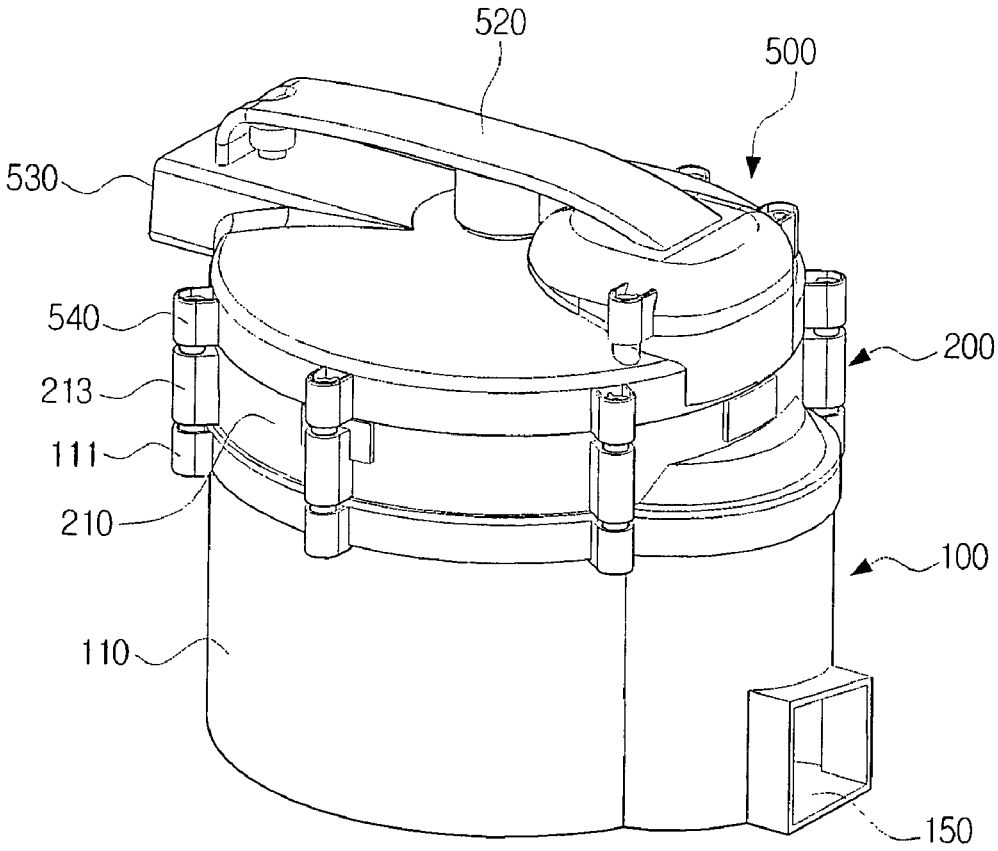
FIG. 1 is a perspective view of a dust collecting apparatus for a vacuum cleaner according to an exemplary embodiment of the present disclosure.
Figure 2:
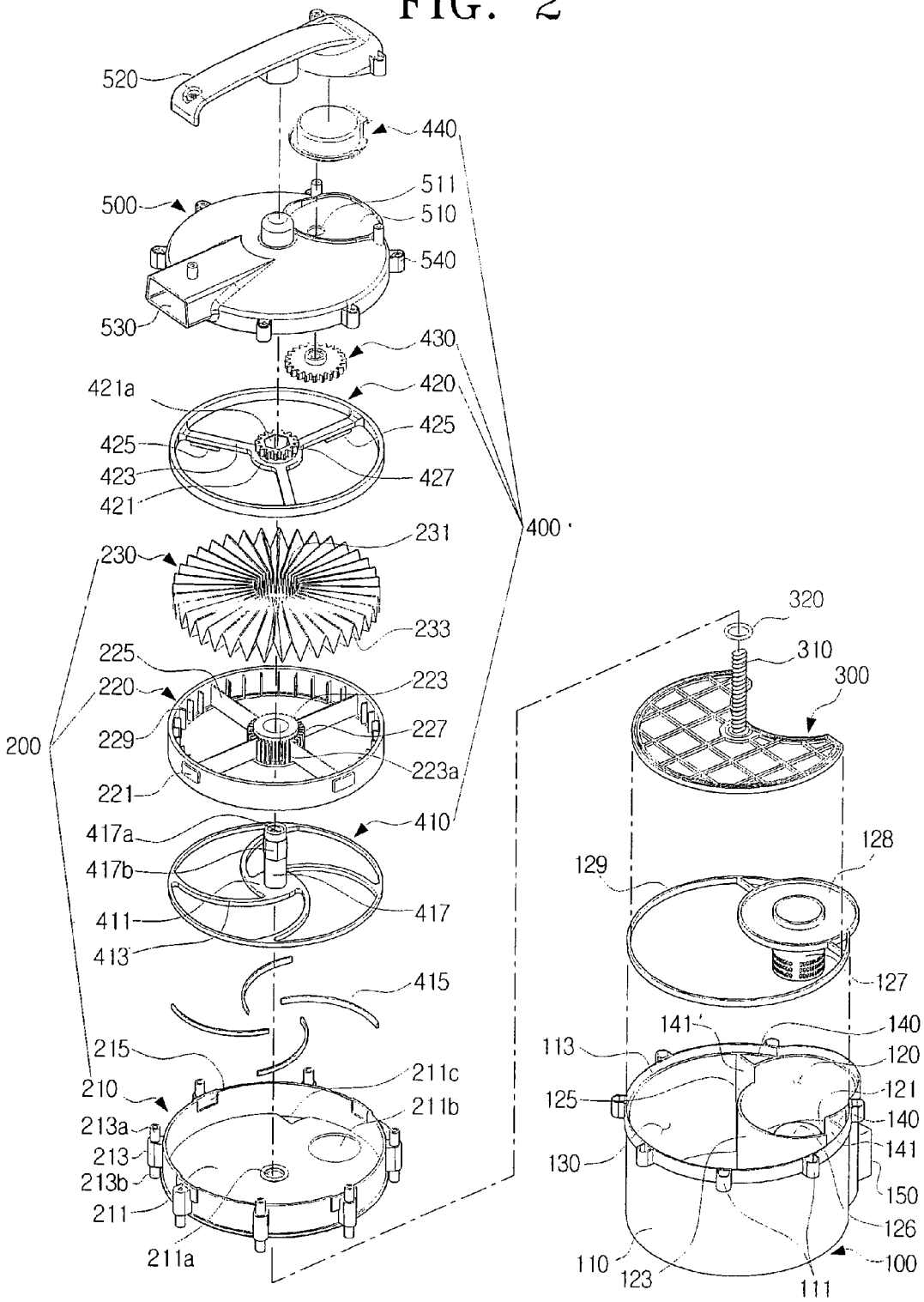
FIGS. 2 and 3 are exploded perspective top and bottom views, respectively, of the dust collecting apparatus of FIG. 1.
Figure 3:
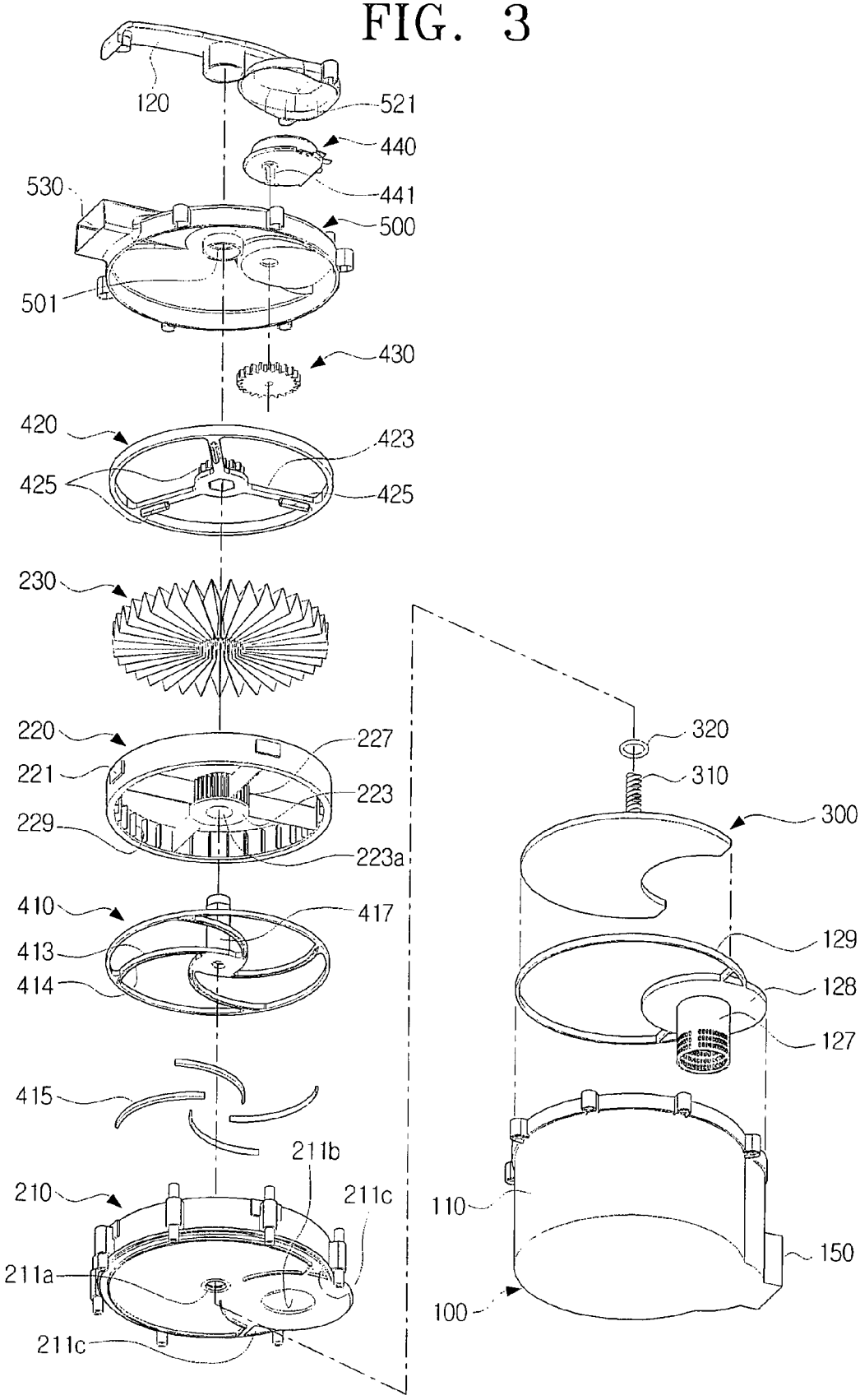

Referring to FIG. 1, a dust collecting apparatus according to an exemplary embodiment of the present disclosure comprises a dust collecting unit 100, a filter unit 200, a dust compression plate 300, a rotating unit 400 and a top cover 500. Hereinafter, the elements 100, 200, 300, 400 and 500 will be described in detail with reference to FIGS. 2 and 3.

The dust collecting unit 100 comprises a dust collecting case 110, and a cyclone chamber 120, a dust collecting chamber 130 and a fine dust collecting chamber 140 which are spaced apart from each other within the dust collecting case 110. Additionally, the dust collecting unit 100 comprises an inlet 150 which fluidly communicates with the cyclone chamber 120.

The dust collecting case 110 has a substantially cylindrical shape having an open upper end and a closed lower end. A plurality of first fixing units 111 protrude at regular intervals along an outside surface of the upper end of the dust collecting case 110 in order to fix the filter unit 200 disposed above the dust collecting case 110.

The cyclone chamber 120 includes a spiral guide 121 which extends a predetermined distance upwards from an area adjacent to the inlet 150. The spiral guide 121 makes drawn-in air and dust flowing through the inlet 150 rotate, so as to effectively separate the drawn-in air from dust in an upper part of the cyclone chamber 120 using a centrifugal force. Additionally, in order to discharge dust separated from the drawn-in air to the dust collecting chamber 130, a blocking plate 128 and a dust discharge space 125 are formed by cutting a portion of an upper side of a first partition 123 which divides the dust collecting case 110 into the cyclone chamber 120 and the dust collecting chamber 130.

A vertical pipe 126 to support the spiral guide 121 is disposed at substantially the center of the cyclone chamber 120. A cylindrical grill filter 127 to guide air separated from dust in the cyclone chamber 120 toward the filter unit 200 is disposed at an upper end of the vertical pipe 126. In this situation, the blocking plate 128 disposed along an outside surface of an upper end of the cylindrical grill filter 127 seals an upper part of the cyclone chamber 120. The blocking plate 128 is supported by a mounting ring 129 fitting into a jaw 113 inside the upper end of the dust collecting case 110.

The dust collecting chamber 130 is disposed adjacent to the cyclone chamber 120. The fine dust collecting chamber 140 is disposed adjacent to both sides of the cyclone chamber 120, and is partitioned from the collecting chamber 130 by a second partition 141.

The filter unit 200 comprises a filter case 210, a filter supporter 220 and a filter 230.

The filter case 210 has an open upper part and a floor 211 for closing the upper part of the dust collecting chamber 130. A first through hole 211*a* through which a threaded rod 310 disposed on a pressing plate 300 penetrates is disposed at substantially the center of the floor 211. A communicating hole 211*b* into which air discharged from the grill filter 127 flows is disposed in a position corresponding to the grill filter 127. A fine dust exhaust outlet 211*c* is disposed in a position corresponding to the fine dust collecting chamber 140 in order to discharge fine dust particles on the floor 211 to the fine dust collecting chamber 140.

A plurality of second fixing units 213 which are aligned with the first fixing units 111 protrude along an outside surface of the filter case 210. In this situation, the second fixing units 213 comprise upper mounting projections 213*a* and lower mounting projections 213*b* which are respectively disposed on upper and lower sides of the second fixing units 213. The upper mounting projections 213*a* detachably fit into a plurality of third fixing units 540 of the top cover 500, and the lower mounting projections 213*b* detachably fit into the first fixing units 111 of the dust collecting case 110. A plurality of grooves 215 are disposed at regular intervals along an inside surface of an upper end of the filter case 210, so that a plurality of fixing projections 221 of the filter supporter 220 can be inserted into the plurality of grooves 215.

The filter supporter 220 has a substantially ring-like shape, and is inserted into the filter case 210 by the plurality of fixing projections 221 disposed on an outside surface of the filter supporter 220. The filter supporter 220 includes a first boss 223 and a plurality of first support ribs 225. The first boss 223 is disposed at substantially the center of the filter supporter 220 and is spaced apart from an inside surface of the filter supporter 220 by the plurality of first support ribs 225 at a predetermined distance. A second through hole 223*a* through which a supporting pipe 417 penetrates is disposed at substantially the center of the first boss 223. Additionally, a plurality of first support pieces 227 are disposed around an outside surface of the first boss 223 at regular intervals along the axis of the first boss 223. A plurality of second support pieces 229 are disposed around an inside surface of the filter supporter 220 at regular intervals along the axis of the filter supporter 220.

The filter 230 is folded in an accordion-like manner and has a substantially circular shape so as to be inserted into the filter supporter 220. The inside 231 and the outside 233 of the filter 230 are mounted by the plurality of first and second support pieces 227 and 229, respectively, and accordingly the filter 230 may be fixed inside the filter supporter 220 without rotation, and may be simultaneously supported by the first support ribs 225 when being mounted. The filter 230 functions to filter fine dust particles contained in air flowing into the filter case 210 through the communicating hole 211*b*.

The dust compression plate 300 has dimensions equal to or less than sectional dimensions of the dust collecting chamber 130, and is disposed in the dust collecting chamber 130 so as to move upwardly and downwardly in the dust collecting chamber 130. An initial position (referring to FIG. 5) of the dust compression plate 300 is at the top of the dust collecting chamber 130, in order not to interfere with the movement of dust flowing from the cyclone chamber 120 to the dust collecting chamber 130 through the dust discharge space 125. The dust compression plate 300 includes the threaded rod 310 which extends upwards for a predetermined length from a top surface of the dust compression plate 300, and the dust compression plate 300 is moved up or down inside the dust collecting chamber 130 by power transferred from the rotating unit 400 through the threaded rod 310. A seal ring 320 is coupled to a portion of the threaded rod 310 in contact with the dust compression plate 300, and accordingly the seal ring 320 may seal off the first through hole 211*a* through which the threaded rod 310 penetrates when the dust compression plate 300 has ascended, and may prevent dust collected in the dust collecting chamber 130 from flowing into the dust collecting case 210.

The rotating unit 400 comprises a first rotating member 410, a second rotating member 420, a drive gear 430 and a motor 440.

The first rotating member 410 is rotatably disposed between a lower side of the filter supporter 220 and the floor 211 of the filter case 210. The first rotating member 410 includes a second boss 411, and a plurality of second support ribs 413, which have a predetermined curvature and connect the second boss 411 to an inside surface of the first rotating member 410. The second support ribs 413 include a plurality of mounting grooves 414 disposed at the bottom surface thereof, into which each wiper 415 is fitted.

The wipers 415 have an arcuate form, and the lower ends of the wipers 415 are in close contact with the floor 211. Accordingly, the wipers 415 may sweep fine dust particles deposited on the floor 211 while moving over the floor 211 following the rotation of the first rotating member 410, and may push the fine dust particles into the fine dust exhaust outlet 211*c*.

The supporting pipe 417 is disposed on a top surface of the second boss 411 and rotatably penetrates through the second through hole 223*a* of the first boss 223. The supporting pipe 417 includes a screw hole 417*a* in which a threaded portion complementary to the threaded rod 310 is formed, so that the threaded rod 310 can be screwed into the screw hole 417*a*. Accordingly, if the first rotating member 410 rotates clockwise and counterclockwise, the threaded rod 310 may raise and lower the dust compression plate 300 inside the dust collecting chamber 130 while moving upwardly and downwardly along the screw hole 417*a*.

The second rotating member 420 is rotatably disposed between a bottom cover 500 and an upper side of the dust collecting case 220. The second rotating member 420 includes a third boss 421 disposed at substantially the center thereof, and a plurality of third support ribs 423. The supporting pipe 417 of the first rotating member 410 penetrates the third boss 421 to be coupled to the third boss 421, and the plurality of third support ribs 423 connect the third boss 421 to an inside surface of the second rotating member 420. In this situation, strike tabs 425 having sufficient thickness to be partially inserted a predetermined distance into upper folded portions of the filter 230 are coupled to bottom surfaces of the third support ribs 423. The strike tabs 425 strike the upper side of the filter 230 while being repeatedly inserted into and removed from the gaps between the upper folded portions of the filter 230, so as to sweep fine dust particles attached to the filter 230 downward onto the floor 211 of the filter case 210. In order to prevent portions of the filter 230 which have been struck by the strike tabs 425 from being damaged, the strike tabs 425 may be formed of a soft material.

A third through hole 421*a* is formed in the third boss 421 of the second rotating member 420 and has a polygonal shape, for example, a hexagonal shape. This is so the third through hole 421*a* can engage with a hexagonal mounting part 417*b* in a portion of the supporting pipe 417 which is inserted into the third through hole 421*a*, to transfer a rotation force exerted by the second rotating member 420 to the first rotating member 410. Accordingly, fine dust particles may be separated from the filter 230 using the strike tabs 425 by simultaneously rotating the first and second rotating members 410 and 420, and the separated dust particles may be deposited on the floor 211 and at the same time may be discharged to the fine dust collecting chamber 140 using the wipers 415.

Additionally, the second rotating member 420 includes a differential gear 427 disposed on a top surface of the third boss 421. The differential gear 427 is meshed with the drive gear 430, so that the second rotating member 420 can rotate using power transferred from the drive gear 430.

A drive shaft 441 of the motor 440 is coupled to the center of the drive gear 430 through an opening 511 of the top cover 500 in order to transfer power exerted by the motor 440 to the differential gear 427.

The motor 440 is disposed in such a manner as to fit into an accommodating part 510 of the top cover 500 and to be separated from the filter unit 200 and the outside of the dust collecting apparatus by a housing part 521 disposed on one side of a grip 520. This arrangement prevents unfiltered fine dust particles in air passing through the filter 230 or dust in air outside the dust collecting apparatus from flowing into the motor 440 as much as possible, and accordingly it is possible to protect the motor 440.

If a predetermined load arises in the motor 440, the driving direction of the motor 440 may be reversed. For example, if the motor 440 is driven in one direction to lower the dust compression plate 300 using the second rotating member 420 until it is impossible for the dust compression plate 300 to compress dust any more, a predetermined load arises in the motor 440. In this situation, in order to protect the motor 440, the driving direction of the motor 440 may be reversed so that the dust compression plate 300 can be raised.

The top cover 500 closes the upper part of the filter unit 200, and simultaneously discharges air discharged from the filter unit 200 through an exhaust outlet 530 disposed on one side of the top cover 500 to the outside of the dust collecting apparatus. The top cover 500 includes the plurality of third fixing units 540 disposed along the outside surface thereof in a position corresponding to the second fixing units 213 of the filter case 210. Additionally, an insertion opening 501 is disposed at substantially the center of the top cover 500 in order to receive an upper end of the threaded rod 310 when the dust compression plate 300 is raised and returned to the initial position (referring to FIG. 5).

The grip 520 is disposed on an upper side of the top cover 500 so that the dust collecting apparatus can be easily separated from the main body (not shown) of the vacuum cleaner.

Hereinafter, processes for compressing dust and cleaning a filter in a dust collecting apparatus according to an exemplary embodiment of the present disclosure will be described with reference to the accompanying drawings.

Figure 4:
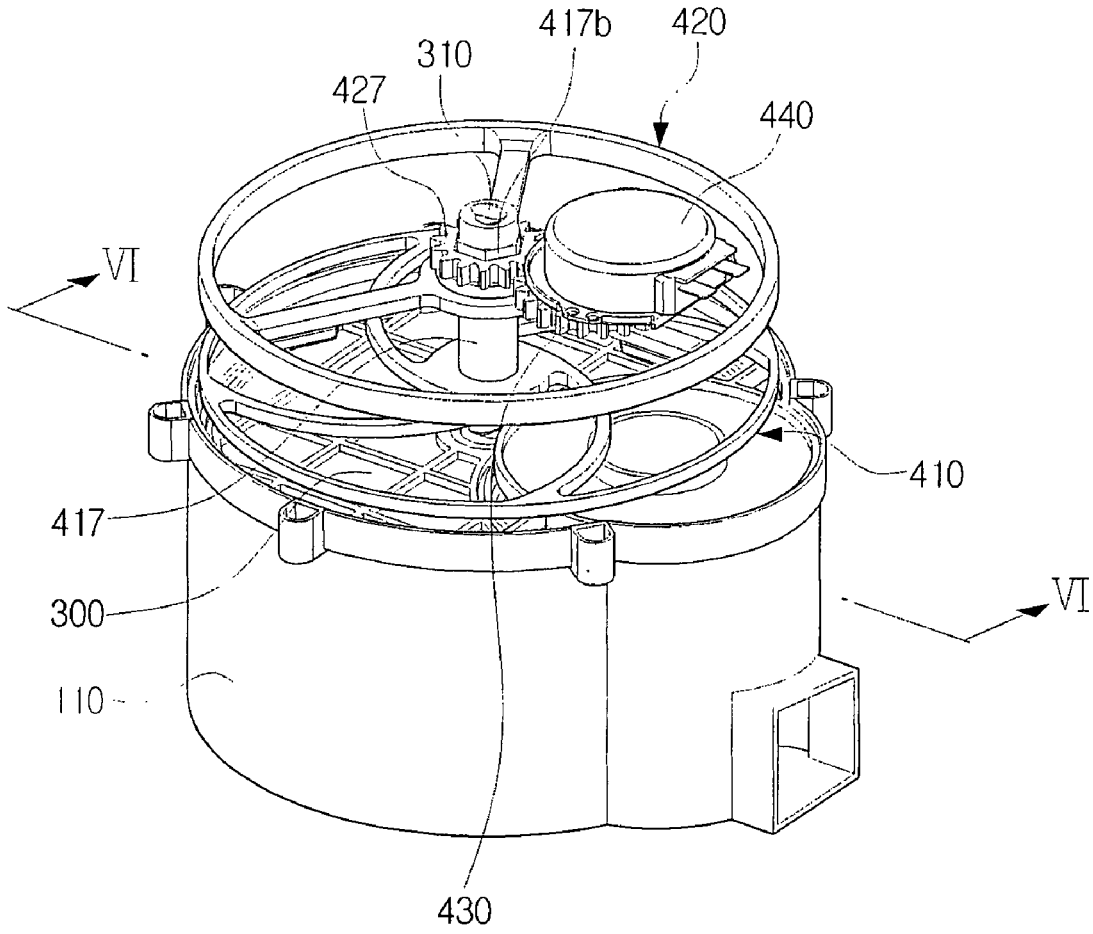
FIG. 4 is a perspective view of a dust compression plate and ascending/descending units to move the dust compression plate up and down, which are mounted in a dust collecting apparatus according to an exemplary embodiment of the present disclosure.
Figure 5:
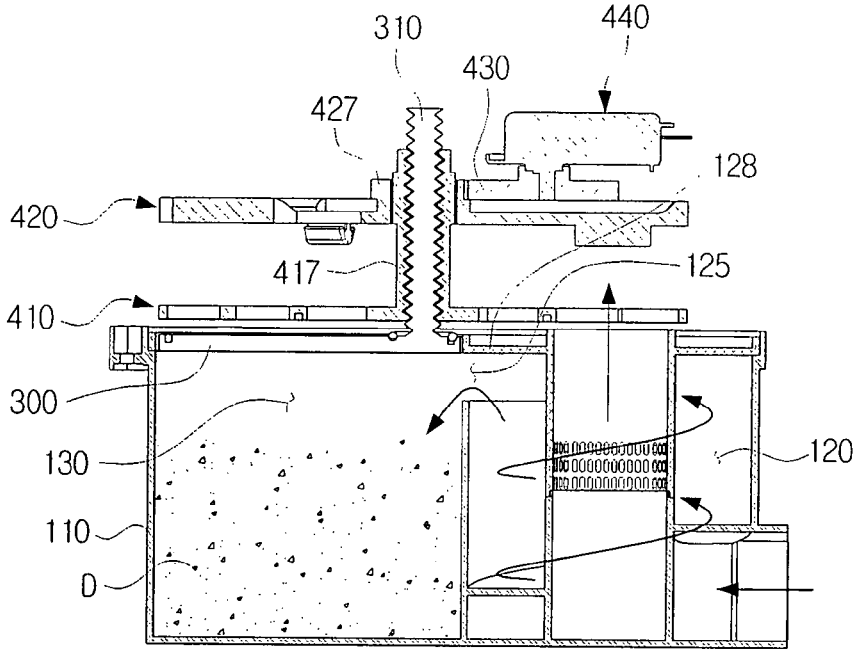
FIG. 5 is a sectional view taken along line VI-VI in FIG. 4.

Referring to FIGS. 4 and 5, the dust compression plate 300 is usually positioned above the dust discharge space 125 in order not to cover the dust discharge space 125. Dust flowing into the cyclone chamber 120 through the inlet 150 along with drawn-in air is separated from the drawn-in air using the centrifugal force, and the separated dust enters and is collected in the dust collecting chamber 130 through the dust discharge space 125. If a predetermined amount of dust D is deposited on the dust collecting chamber 130 as shown in FIG. 5, a user may drive the motor 440 through a predetermined operation switch (not shown) mounted in a handle part (not shown) or in the main body (not shown) of the vacuum cleaner after operation of the vacuum cleaner has been halted.

In this situation, the drive gear 430 is rotated in one direction by the motor 400 to drive the differential gear 427 meshed with the drive gear 430. The second rotating member 420 is rotated in one direction by the differential gear 427, and the first rotating member 410 together with the second rotating member 420 is also rotated by power transferred through the supporting pipe 417.

Figure 6:
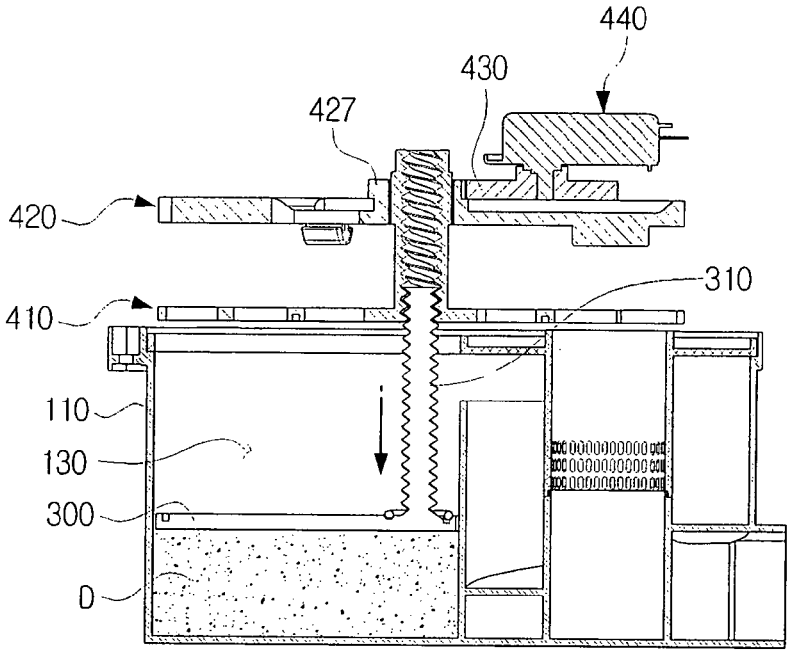
FIG. 6 is a sectional view showing a situation in which the dust compression plate of FIG. 5 is lowered so as to compress dust in a dust collecting case.

While the threaded rod 310 screwed into the supporting pipe 417 of the first rotating member 410 being rotated in one direction is being moved down along the supporting pipe 417, the dust compression plate 300 is lowered inside the dust collecting chamber 130, as shown in FIG. 6. Accordingly, dust D collected in the dust collecting chamber 130 may be compressed increasingly by lowering the dust compression plate 300, and a predetermined space to collect a significant amount of dust may be defined in the dust collecting chamber 130.

If dust is completely compressed and there is no need to lower the dust compression plate 300, a predetermined load arises in the motor 440. If the load arises, the motor 440 may be driven in a direction opposite the original direction, and the first and second rotating members 410 and 420 may be rotated in reverse, and the drive gear 430 and differential gear 427 may be rotated in reverse, in a reverse manner to the situation of lowering the dust compression plate 300 described above.

Accordingly, while the threaded rod 310 screwed into the supporting pipe 417 of the first rotating member 410 being rotated in reverse is being moved up along the supporting pipe 417, the dust compression plate 300 is raised inside the dust collecting chamber 130 so as to be returned to the initial position, as shown in FIG. 5.

Although the driving direction of the motor 440 is reversed due to the load arising in the motor 440 as describe above, the present disclosure is not limited thereto. Accordingly, a limit switch (not shown) or a hole sensor (not shown) may be mounted in predetermined positions on upper and lower inner walls of the dust collecting chamber 130, respectively, so that the raised and lowered positions of the dust compression plate 300 can be detected and the driving direction of the motor 440 can be reversed.

Figure 7:
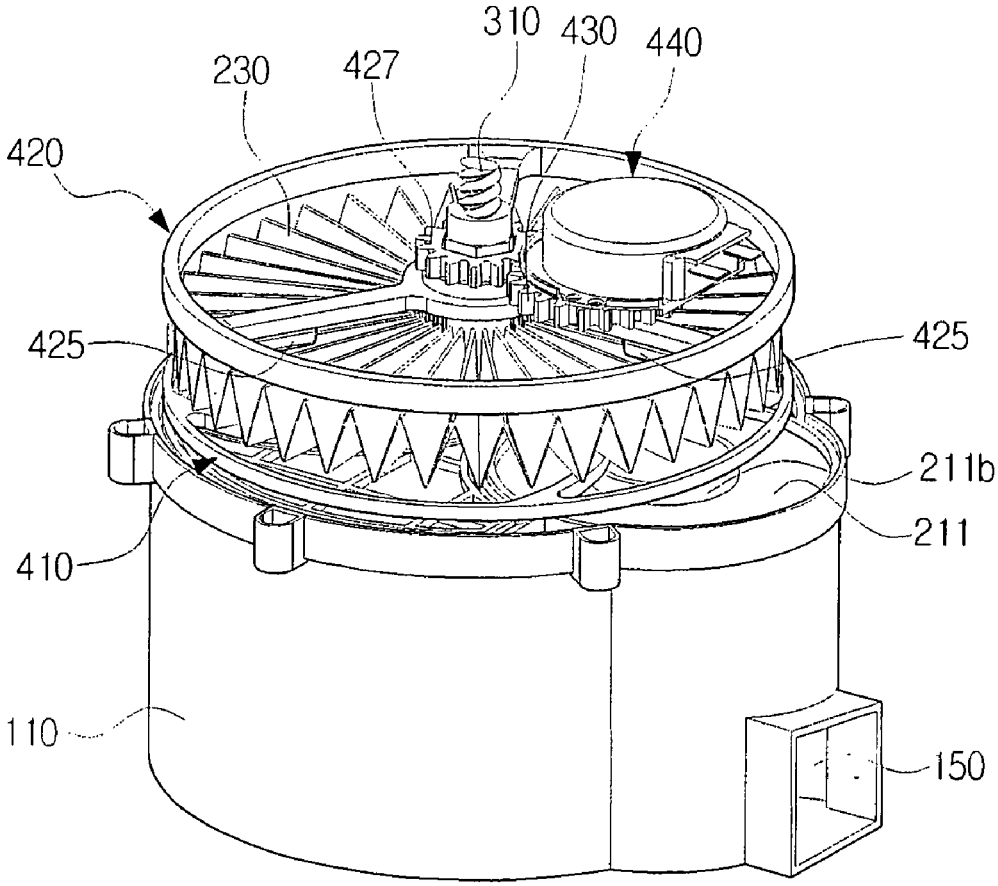
FIG. 7 is a perspective view of a filter unit mounted in a dust collecting apparatus according to an exemplary embodiment of the present disclosure.

The dust collecting apparatus according to the exemplary embodiment of the present disclosure may clean the filter while compressing dust, as described above. Such a process of cleaning a filter is now described with reference to FIGS. 7 and 8.

Power is transferred in the order of the drive gear 430, differential gear 427 and first and second rotating members 410 and 420 according to the driving direction of the motor 440, in the same manner as the process of compressing dust described above, so detailed description thereof is omitted.

If the second rotating member 420 is rotated, the plurality of strike tabs 425 may strike the upper side of the filter 230 while being repeatedly inserted into and removed from the gaps between the upper folded portions of the filter 230. Accordingly, fine dust particles attached to the filter 230 may be removed from the filter 230 to allow the fine dust particles to descend onto the floor 211 of the filter case 210 to be deposited thereon.

Figure 8:
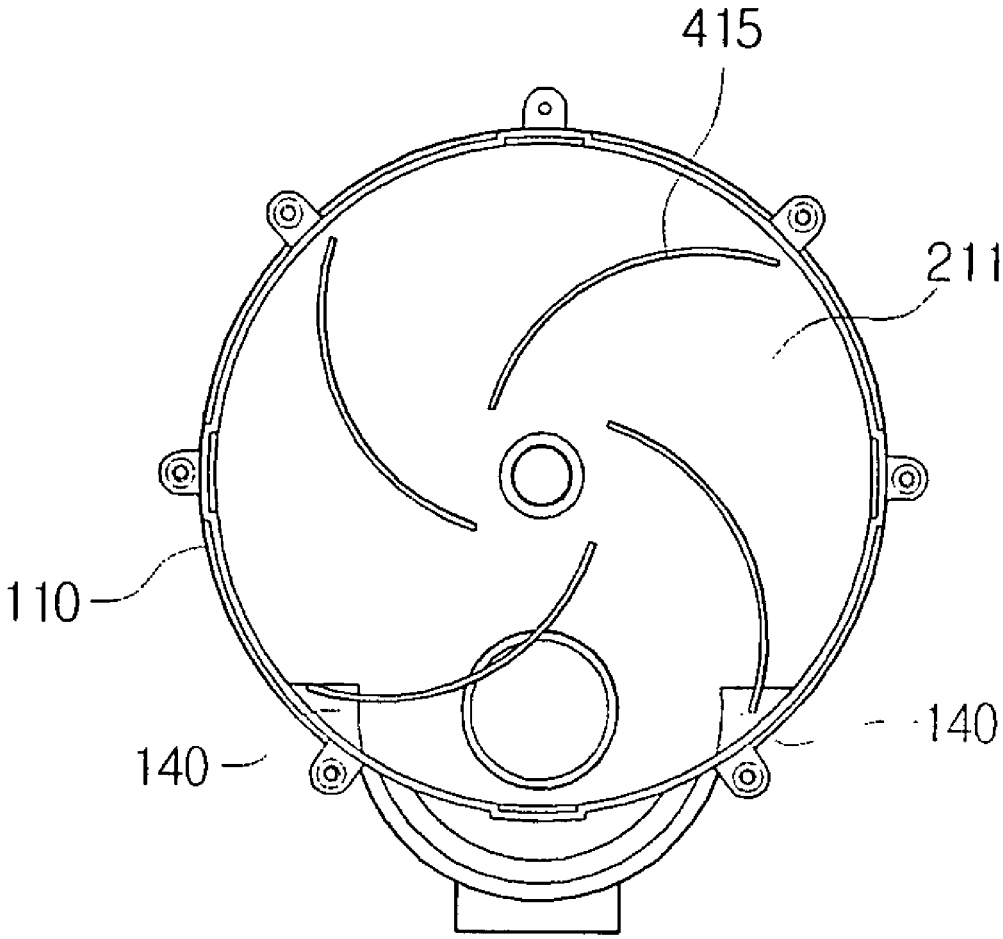
FIG. 8 is a plane view of a wiper disposed in a dust collecting apparatus according to an exemplary embodiment of the present disclosure.

The fine dust particles deposited on the floor 211 may be removed outwardly from the center of the floor 211 by the plurality of wipers 415 which rotate together with the first rotating member 410, as shown in FIG. 8, and as a result, the fine dust particles may be discharged to the fine dust collecting chamber 140.

The fine dust particles detached from the filter 230 are collected in the fine dust collecting chamber 140 by being removed from the floor 211, and thus it is possible to prevent the fine dust particles flowing into the connecting hole 211*b* of the floor 211 together with air from being reattached to the filter 230 during vacuum cleaning.

In the exemplary embodiment of the present disclosure, the dust compression plate is raised and lowered using power transferred from the motor to compress dust and simultaneously to remove dust attached to the filter from the filter, so there is no need for a user to clean a filter separately. Additionally, a filter may be maintained in a clean condition, and thus the efficiency of the filter in fine dust particles can increase and it is possible to prevent a suction force used to draw in dust from a surface to be cleaned from being reduced due to an increase in pressure inside the dust collecting apparatus.

Furthermore, according to the exemplary embodiment of the present disclosure, each power source for dust compression and filter cleaning is not required separately, and thus the number of units is reduced to reduce manufacturing costs. Additionally, a compact dust collecting apparatus can be maintained.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A dust collecting apparatus for a vacuum cleaner, comprising:

a dust collecting unit detachably mounted in a main body of the vacuum cleaner, the dust collecting unit being configured to separate and collect dust from drawn-in air flowing therein;

a filter unit disposed above the dust collecting unit, the filter unit comprising a filter to filter fine dust particles contained in air from which the dust has been separated by the dust collecting unit;

a top cover to cover the filter unit and to discharge the air filtered through the filter;

a rotating unit disposed inside the filter unit, the rotating unit being configured to strike a portion of the filter and to remove the fine dust particles attached to the filter; and a dust compression plate to compress the collected dust while being moved up and down in a longitudinal direction of the dust collecting unit inside the dust collecting unit by power transferred from the rotating unit, wherein the rotating unit comprises:

a motor which is disposed on the top cover in such a manner as to be separated from the filter unit;

a first rotating member which is rotatably disposed below the filter;

a second rotating member rotatably disposed above the filter that receives power from the motor, the second rotating member being configured to rotate in the same direction as the first rotating member by transferring power to the first rotating member;

one or more striking members attached to the second rotating member, the one or more striking members being configured to strike the filter following the rotation of the second rotating member while being in contact with the filter; and one or more wipers which are coupled to the first rotating member to discharge to the dust collecting unit the dust, which is detached from the filter by the one or more striking members and deposited onto a floor of the dust collecting unit.

2. The dust collecting apparatus as claimed in claim 1, further comprising:

a cyclone chamber to separate dust flowing into the dust collecting unit from air using a centrifugal force;

a dust collecting chamber to collect the dust separated by the cyclone chamber, the dust collecting chamber being spaced apart from the cyclone chamber; and one or more fine dust collecting chambers to collect fine dust particles discharged from the filter unit, the one or more fine dust collecting chambers being spaced apart from the cyclone chamber and dust collecting chamber, respectively.

3. The dust collecting apparatus as claimed in claim 1, wherein the filter of accordion appearance having pleats and a substantially circular shape is fixedly mounted inside the dust collecting unit, and wherein the one or more striking members have sufficient thickness to be partially inserted into upper folded portions of the filter.

4. The dust collecting apparatus as claimed in claim 1, wherein the one or more wipers have an arcuate form.

5. The dust collecting apparatus as claimed in claim 1, wherein the first rotating member integrally comprises a supporting pipe, which penetrates the filter and is connected to the second rotating member.

6. The dust collecting apparatus as claimed in claim 5, wherein the dust compression plate integrally comprises a threaded rod which is screwed into a screw hole of the supporting pipe, and wherein the dust compression plate is moved up and down inside the dust collecting unit, according to movement of the threaded rod along the supporting pipe by the supporting pipe in which the threaded rod is rotated clockwise and counterclockwise in contact with the first rotating member.

7. The dust collecting apparatus as claimed in claim 6, wherein the motor has a rotating direction that reverses due to a load arising in the motor, and wherein the load is caused by the descent of the dust compression plate which is moved down by rotating the first and second rotating members in one direction being impeded due to the dust being completely compressed.

8. The dust collecting apparatus as claimed in claim 6, wherein the motor has a rotating direction that changes according to whether the dust compression plate is being raised or lowered, which is detected by a pair of limit switches or a pair of hole sensors mounted in predetermined positions on upper and lower inner walls of the dust collecting unit, respectively.

9. The dust collecting apparatus as claimed in claim 1, wherein the one or more striking members are formed of soft materials in order to prevent the filter from being damaged when the filter is struck.

* * * * *